US010808722B2

(12) United States Patent
Theux

(10) Patent No.: US 10,808,722 B2
(45) Date of Patent: Oct. 20, 2020

(54) PITCH CONTROL RING FOR A STATOR VANE STAGE

(71) Applicant: SAFRAN AIRCRAFT ENGINES, Paris (FR)

(72) Inventor: Axel Theux, Paris (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 121 days.

(21) Appl. No.: 15/911,300

(22) Filed: Mar. 5, 2018

(65) Prior Publication Data

US 2018/0258951 A1 Sep. 13, 2018

(30) Foreign Application Priority Data

Mar. 7, 2017 (FR) ..... 17 00227

(51) Int. Cl.
*F04D 29/02* (2006.01)
*F04D 29/56* (2006.01)
*F04D 29/54* (2006.01)

(52) U.S. Cl.
CPC ..... *F04D 29/563* (2013.01); *F04D 29/023* (2013.01); *F04D 29/542* (2013.01); *F05D 2300/501* (2013.01); *F05D 2300/50211* (2013.01)

(58) Field of Classification Search
None
See application file for complete search history.

(56) References Cited

U.S. PATENT DOCUMENTS 3,736,070 A * 5/1973 Moskowitz ..... F01D 17/16 415/147
3,841,788 A * 10/1974 Sljusarev ..... F01D 17/162 415/147
3,841,790 A * 10/1974 Stein ..... F04D 27/0246 415/159
4,373,859 A * 2/1983 Thebert ..... F01D 17/20 415/134
4,810,165 A * 3/1989 Greune ..... F01D 17/162 415/134
5,700,129 A * 12/1997 Kocian ..... F01D 17/162 403/30

(Continued)

FOREIGN PATENT DOCUMENTS

EP 2 053 203 A1 4/2009
EP 2 211 026 A2 7/2010
EP 2 889 453 A1 7/2015

OTHER PUBLICATIONS

Search Report issued in French Patent Application No. 1700227 dated Jan. 16, 2018.

*Primary Examiner* — Aaron R Eastman
*Assistant Examiner* — Theodore C Ribadeneyra
(74) *Attorney, Agent, or Firm* — Pearne & Gordon LLP

(57) ABSTRACT

An angular pitch control ring (8) of stator vanes (2), the rotations of which are controlled by a mechanism (6) applying a thrust tangent to the ring (8), is also moved in translation when it is displaced, making it touch the stator (2). According to the invention, one lateral region (13) on one side of the mechanism (6) is constructed to be stiffer than the other region to take account of the larger forces that the mechanism (6) must apply in a direction of movement. Application to turbomachines.

13 Claims, 1 Drawing Sheet

(56) References Cited

U.S. PATENT DOCUMENTS

Figure 1:
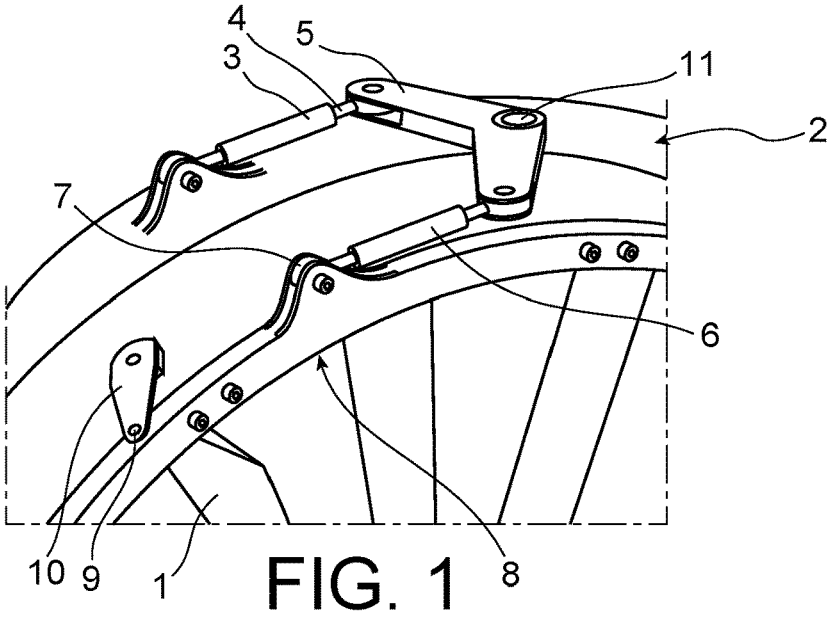

| | | | | |
|---|---|---|---|---|
| 7,300,245 | B2 * | 11/2007 | Bouru | F04D 29/563 415/147 |
| 7,938,620 | B2 * | 5/2011 | Bouru | F01D 17/162 415/160 |
| 8,435,000 | B2 * | 5/2013 | Wong | F01D 17/162 415/160 |
| 8,511,974 | B2 * | 8/2013 | Hood | F01D 17/16 415/149.2 |
| 10,180,076 | B2 * | 1/2019 | Emmons | F01D 17/20 |
| 2014/0314540 | A1 * | 10/2014 | Do | F02C 9/20 415/1 |
| 2015/0184535 | A1 * | 7/2015 | Dougherty | F01D 9/041 415/1 |
| 2016/0319693 | A1 * | 11/2016 | Ward | F04D 29/563 |
| 2016/0363133 | A1 * | 12/2016 | Mouton | F01D 17/162 |
| 2017/0241436 | A1 * | 8/2017 | Theux | F01D 17/162 |

* cited by examiner

PITCH CONTROL RING FOR A STATOR VANE STAGE

The subject of the invention is a pitch control ring for a stator vanes stage.

Variable stator vanes are characterised by a variable orientation depending on speed of the machine of which they form part, to optimise operation, particularly of compressors. The angular pitch is fixed by rotating a ring surrounding the stator, to which levers fixed to vane pivots are articulated. The ring rotation is controlled by a device typically comprising an actuator fixed to the stator, an actuator movements transmission that may include a bellcrank (triangular part articulated at its vertices) and a turnbuckle or rod articulated to a clevis at the periphery of the ring.

It has been found that the mechanical load on the control ring is asymmetric depending on the direction of angular displacement imposed on it, for two reasons. The first reason is related to the gas flow in the machine, that applies a lateral thrust and a rotation moment on the vanes and their pivots, therefore tending to rotate the ring in one direction with the result that the force to be applied by the control mechanism to move the ring is much lower in one direction than in the other; the second reason is that since the ring is free to rotate about the stator casing, the forces necessary to rotate it displace it in translation and make it touch the stator casing at opposite portions depending on the direction of the force, and that produce different bending deformations around the ring.

This asymmetry is responsible for a degradation of the precision of the angular pitch of the vanes. This can be overcome by increasing the stiffness of the ring to make it less deformable, or to have it simultaneously controlled by several turnbuckle mechanisms distributed around its circumference. Such arrangements, and especially the latter, have the disadvantage that they increase the weight of the device, that can become unacceptable for small-size machines, for which low weight is essential.

The invention relates to a stator vane pitch control ring that is not very sensitive to operating asymmetries depending on the direction of rotation imposed on it, and that is less heavy than known improvements.

In its general form, the ring according to the invention is composed of two halves having structures with different stiffnesses, located on each side of an articulation clevis of a control mechanism.

The reason for this arrangement is explained as follows. In the direction of rotation for which the force to be applied is lowest, the load and the contact of the ring on the stator casing do not produce any major deformations of the ring; in the other direction of rotation in which the control force must be much higher and the side opposite the ring is pressed on the casing more strongly, a more rigid structure is necessary at least on the side of the ring that is opposite the bearing portion, while the side of the ring that is bearing on the casing is less exposed to these deformations, and therefore the light structure is sufficient for it.

In other words, the half of the ring that bears on the rotor casing in the direction of rotation corresponding to large forces, but is freed from it in the other direction for which forces are lower, can be lighter than the other half.

The first of the halves (corresponding to the light part of the ring) is advantageously composed of a unit section beam, the other half can be composed of a structure formed by two concentric sections connected together by connecting sections.

The unit section beam can be composed of straight segments joined to each other forming a portion of a regular polygon, and control lever articulation bushings can be arranged at the junctions of these segments.

The ring is advantageously controlled by a single mechanism. Another aspect of the invention is a turbomachine compressor comprising such a ring.

Figure 2:
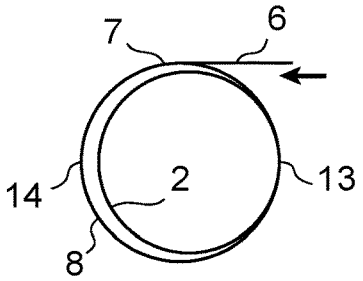
Figure 3:
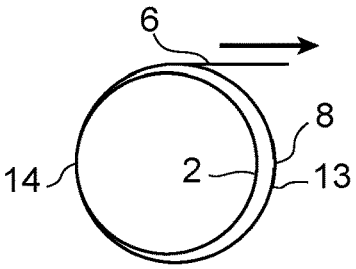
Figure 4:
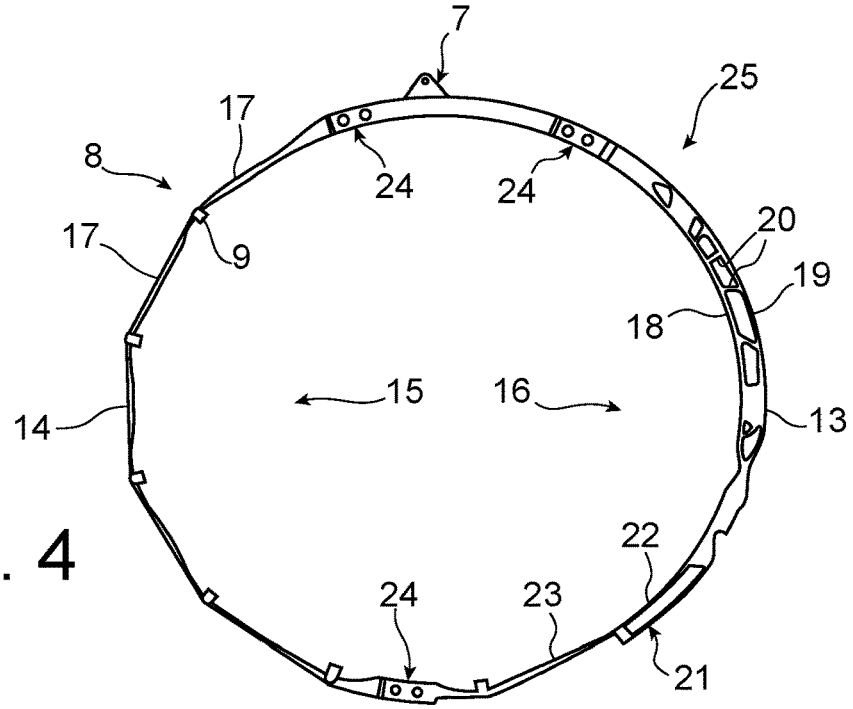

The invention will now be described in more detail with reference to the following figures:

FIG. 1 diagrammatically represents a usual variable stator vane mechanism and control ring;

FIGS. 2 and 3 illustrate operation of the ring;

and FIG. 4 illustrates one embodiment of the invention, given for purely illustrative purposes and not exclusive of other embodiments.

FIG. 1 represents vanes 1 of a flow straightener placed in the circular stage in a stator casing 2 of a turbomachine that is not shown in full. The casing 2 carries an actuator 3 of which the arm 4 can be extended under the action of a control device and that rotates an aeronautical bellcrank 5 installed rotating on casing 2. The opposite side of the bellcrank 5 is articulated to a turnbuckle 6, that is articulated at its opposite end to a clevis 7 at the external periphery of a pitch control ring 8 of the vanes 1 and that carries pin housing bushings 9 at regular intervals at the free ends of levers 10, that drive pivots 11 of vanes 1 that pass through the casing 2, in rotation.

FIGS. 2 and 3 illustrate operation of the pitch control ring 8. The force applied by the turnbuckle 6, tangential to the ring 8, also results in translation of the ring, of which part of the circumference touches the casing 2 depending on the imposed direction of rotation: a part 13 at the right on FIG. 2, for a force in the turnbuckle 6 directed towards the left in FIG. 2 so as to impose an anti-clockwise rotation on ring 8, and a part 14 at the left in FIG. 3, for a force in the turnbuckle 6 directed towards the right in FIG. 3 so as to impose a clockwise rotation on the ring 8. These parts 13 and 14 are diametrically opposite and at a right angle to the articulation clevis 7 of the turnbuckle 6.

FIG. 4 illustrates one possible embodiment of the ring 8. Two halves 15 and 16 can be distinguished that are different from each other, joining together at the clevis 7 and each extending over about half the circumference, the first on the side of part 14 and the second on the side of part 13.

The first half 15 is a relatively lightweight and relatively flexible structure, composed of a beam, in other words a profile with a unit section. The cross-section of the beam is a classical shape such as L, T, etc. or as in this case an I. It may be constructed by bending an initially straight section into a regular polygon sector of which the bushings 9 are at the vertices and that connect segments 17 of the section that remained straight. A profile with an open cross-section, apart from being lighter weight and less rigid, is very suitable for this type of fabrication.

The second half 16 is formed, at least at a central part comprising the part 13, from a more massive structure and therefore more rigid that the first part, in this case composed of two web profiles made of flat sections 18 and 19 curved into arcs of a circle and arranged concentrically, and lateral profiles 20 connecting the web sections 18 and 19 forming different angles with them to form a very rigid lattice structure.

This second half is less regular than the other half. The ring 8 must be reinforced firstly in the part 13 furthest from the part 14 in contact on the casing 2. It can be seen that a part 21 of the second half 16 connecting the central part 13 to the first half 15 becomes less and less rigid relative to the first part, because it corresponds to a sector of the ring 8 with less and less load with increasing distance from the clevis 7 and reducing distance from the first half 15: it comprises firstly a sub-part 22 comprising only the web sections 18 and 19, and then a sub-part 23 comprising only the web section 18; on the other side of the central part 13, a part 25 of the junction to clevis 7 nevertheless remains latticed, since it is subject to high bending forces in the situation in FIG. 3.

Although the ring structure 8 is heterogeneous, it is recommended that its material should be homogeneous or even that the halves 15 and 16 should be composed of two materials with the same thermal expansion characteristics (the same coefficient), so as not to introduce new control imprecisions due to differential thermal expansion (that could also embrittle assemblies between different materials).

The structure of the ring 8 is inert and static, in other words its properties do not vary as a function of mechanisms associated with the ring 8 to assume variable control states, when only the usual mechanism for rotating the ring 8 is present. In particular, the shape, dimensions and stiffness of the ring 8 and its individual parts remain invariable (for example neglecting deformations due to forces and temperature variations).

The lengths of the halves 15 and 16 are not necessarily equal.

They are connected to each other, opposite the clevis 7, and to the ends of the clevis 13, by bolted assemblies 24.

The invention claimed is:

1. A pitch control ring for a stator vane stage of a stator, said ring comprising two halves having structures with different, invariable stiffnesses, located on each side of a clevis, the ring being controlled by a single actuator articulated to the clevis and that rotates the ring around the stator.

2. The pitch control ring according to claim 1, wherein a first of the two halves is composed of a unit section beam.

3. The pitch control ring according to claim 2, wherein the beam is composed of straight segments assembled together to form a sector of a regular polygon.

4. The pitch control ring according to claim 3, wherein articulation bushings for control levers of the vanes are located at junctions between the segments.

5. The pitch control ring according to 2, wherein a second of the two halves comprises a part with a structure composed of two curved and concentric web sections connected together by connection profiles.

6. The pitch control ring according to claim 5, wherein the connecting profiles are oblique at different angles from the web sections.

7. The pitch control ring according to claim 5, wherein said part extends to a region of the ring at a right angle from the clevis.

8. The pitch control ring according to claim 7, wherein said part extends to a junction with the clevis.

9. The pitch control ring according to claim 5, wherein the second of the two halves is attached to the first of the two halves by a second part, that is less rigid than said part.

10. The pitch control ring according to claim 1, wherein the halves are composed of materials with the same thermal expansion characteristics.

11. The pitch control ring according to claim 1, wherein the pitch control ring is inert and static.

12. A turbomachine compressor comprising a variable pitch blades stage controlled by a control ring composed of two halves having structures with different, invariable stiffnesses, located on each side of a control mechanism articulation clevis wherein a single actuator rotates the control ring.

13. A pitch control ring for a stator vane stage, comprising two halves having structures with different stiffnesses, located on each side of a control mechanism articulation clevis, wherein a first of the two halves has a structure which has a larger thickness than a structure of a second of the two halves.

* * * * *